US009110404B2

(12) United States Patent
Nakamura

(10) Patent No.: US 9,110,404 B2
(45) Date of Patent: Aug. 18, 2015

(54) IMAGE FORMING APPARATUS AND TONER CASE

(71) Applicant: KYOCERA DOCUMENT SOLUTIONS INC., Osaka-shi, Osaka (JP)

(72) Inventor: Satoru Nakamura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/223,986

(22) Filed: Mar. 24, 2014

(65) Prior Publication Data

US 2014/0286679 A1 Sep. 25, 2014

(30) Foreign Application Priority Data

Mar. 25, 2013 (JP) ..... 2013-061400

(51) Int. Cl.
*G03G 15/08* (2006.01)
*G03G 21/16* (2006.01)

(52) U.S. Cl.
CPC ..... *G03G 15/0886* (2013.01); *G03G 21/1633* (2013.01)

(58) Field of Classification Search
CPC ..... G03G 15/0886
USPC ..... 399/119, 258, 262
See application file for complete search history.

(56) References Cited

U.S. PATENT DOCUMENTS

2010/0329747 A1* 12/2010 Kouda ..... 399/262

FOREIGN PATENT DOCUMENTS

JP 2009-168856 A 7/2009

* cited by examiner

*Primary Examiner* — Sandra Brase
(74) *Attorney, Agent, or Firm* — Studebaker & Brackett PC

(57) ABSTRACT

An image forming apparatus includes a toner case, an apparatus main body, and a cover. The toner case includes a case main body, a shutter, and an operation part. The case main body has a discharge port discharging a toner. The shutter opens/closes the discharge port. The operation part is connected to the shutter. The operation part is movable between a port closing position where the operation part makes the shutter close the discharge port and interferes with the cover and an port opening position where the operation part makes the shutter open the discharge port and permits the cover to be closed. When the cover is closed in the state in which the operation part is located at the port closing position, the cover presses the operation part and the operation part moves from the port closing position to the port opening position.

14 Claims, 15 Drawing Sheets

IMAGE FORMING APPARATUS AND TONER CASE

INCORPORATION BY REFERENCE

This application is based on and claims the benefit of priority from Japanese Patent application No. 2013-061400 filed on Mar. 25, 2013, the entire contents of which are incorporated herein by reference.

BACKGROUND

The present disclosure relates to an image forming apparatus and a toner case installed to the image forming apparatus.

An electrographic image forming apparatus carries out the development process by supplying a toner (a developer) from a development device to an electrostatic latent image formed on the surface of a photosensitive drum or the like. The toner used in such development process is supplied from a toner case configured to be attachable and detachable to an apparatus main body of the image forming apparatus.

The above-mentioned toner case includes a case main body having a discharge port discharging the toner and a shutter opening/closing the discharge port. For example, there is a toner case having a shutter rotatably installed to the case main body and opening/closing the discharge port in accordance with the rotation. In such a technique, a locking member attached to the toner case locks the shutter in a closing state, thereby preventing the toner from leaking from the toner case during transport of the toner case.

The above-mentioned technique is provided presupposing the transport of single toner case. In this case, the toner case is separately packed from the apparatus main body, and accordingly, the capacity and number of the packaging material are unnecessarily increased, thereby incurring an increase of a shipping cost.

Moreover, in the imaging forming apparatus including the tone case configured as mentioned above, there is a case that the toner case is installed, in a situation of the shutter closing the discharge port, to the apparatus main body and a cover to cover the toner case is closed by operation mistake of a worker, such as a user. In such a case, it is difficult to supply the toner from the toner case to the development device.

SUMMARY

In accordance with an embodiment of the present disclosure, an image forming apparatus includes a toner case, an apparatus main body, and a cover. The toner case includes a case main body, a shutter, and an operation part. The case main body has a discharge port configured to discharge a toner. The shutter is configured to open/close the discharge port. The operation part is connected to the shutter. To the apparatus main body, the toner case is attachably/detachably installed. The cover is openably/closably attached to the apparatus main body and covers at least apart of the toner case. The operation part is configured to be movable between a port closing position where the operation part makes the shutter close the discharge port and interferes with the cover and an port opening position where the operation part makes the shutter open the discharge port and permits the cover to be closed without interfering with the cover. When the cover is closed in the state in which the operation part is located at the port closing position, the cover presses the operation part and the operation part moves from the port closing position to the port opening position.

In accordance with an embodiment of the present disclosure, a toner case is attachably/detachably installed to an apparatus main body of an image forming apparatus. The toner case is at least partly covered by a cover openably/closably attached to the apparatus main body. The toner case includes a case main body, a shutter, and an operation part. The case main body has a discharge port configured to discharge a toner. The shutter is configured to open/close the discharge port. The operation part is connected to the shutter. The operation part is configured to be movable between a port closing position where the operation part makes the shutter close the discharge port and interferes with the cover and an port opening position where the operation part makes the shutter open the discharge port and permits the cover to be closed without interfering with the cover. When the cover is closed in the state in which the operation part is located at the port closing position, the cover presses the operation part and the operation part moves from the port closing position to the port opening position.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

First Embodiment

Figure 1:
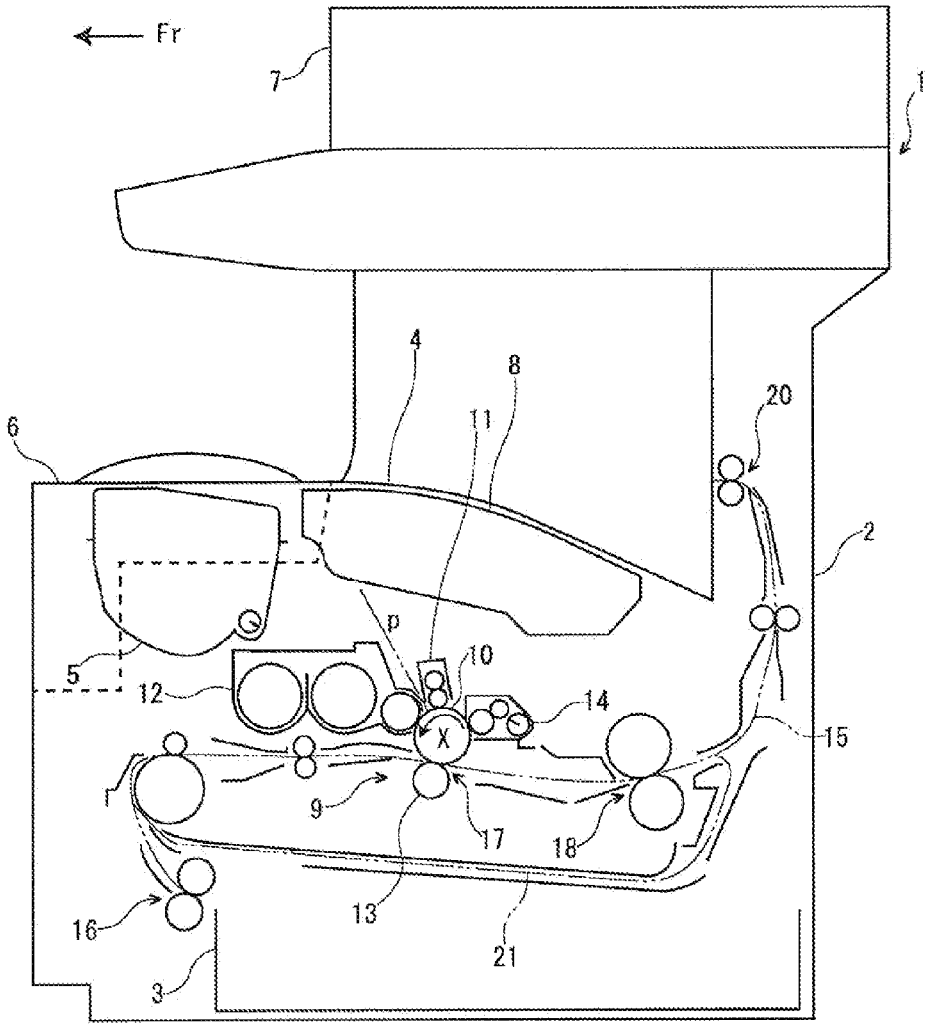
FIG. 1 is a schematic diagram schematically showing a printer according to a first embodiment of the present disclosure.
Figure 2:
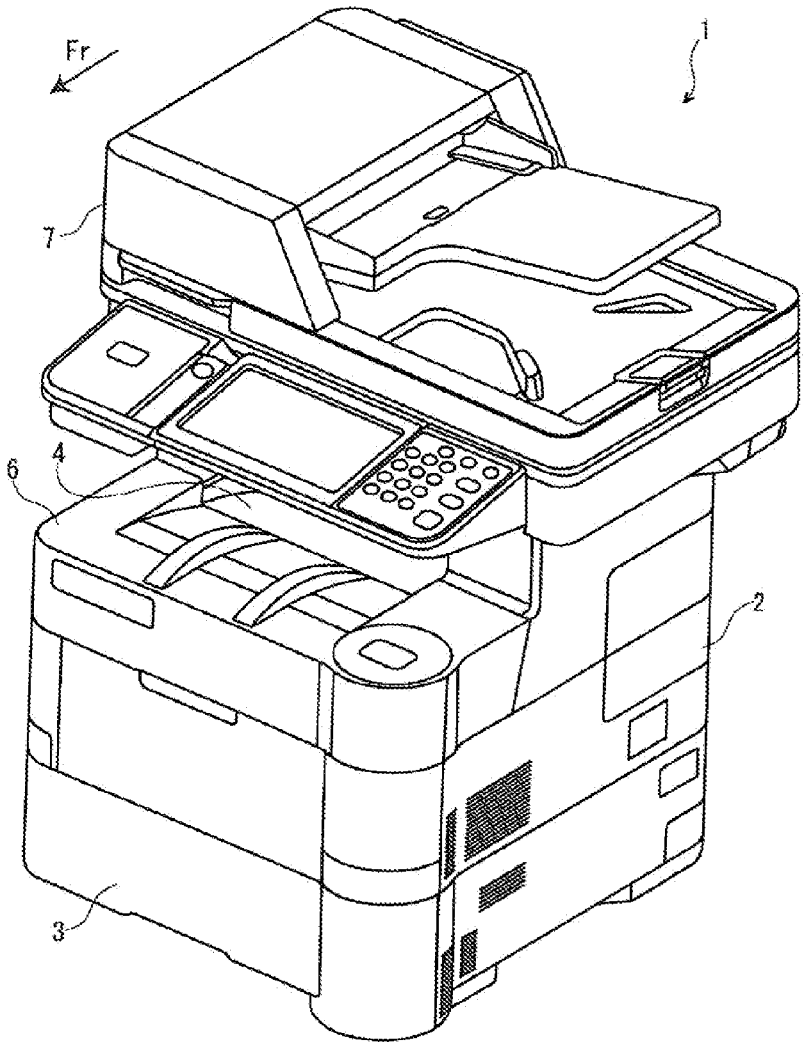
FIG. 2 is a perspective view showing the printer according to the first embodiment of the present disclosure.

With reference to FIG. 1 and FIG. 2, the entire structure of an electrographic printer 1 (an image forming apparatus) will be described. Arrows Fr put on FIG. 1 and FIG. 2 indicate the front side of the printer 1 (FIG. 3 and other figure is illustrated in similar way).

The printer 1 includes a box-formed printer main body 2 (apparatus main body). To a lower part of the printer main body 2, a sheet feeding cartridge 3 configured to store sheets (not shown) is installed and, to an intermediate part in upper and lower direction of the printer main body 2, an ejecting tray 4 is installed. To the upper front part of the printer main body 2, a toner container 5 (a toner case) is attachably/detachably installed and, above the toner container 5, an front cover 6 (cover) is openably/closably attached. To the upper end part of the printer main body 2, an image reading device 7 is installed.

As shown in FIG. 1, To the printer main body 2, an exposure device 8 composed of a laser scanning unit (LSU) is installed below the sheet ejecting tray 4. Below the exposure device 8, an image forming unit 9 is installed. To the image forming unit 9, a photosensitive drum 10 as an image carrier is rotatably installed. Around the photosensitive drum 10, a charger 11, a development device 12, a transfer roller 13 and a cleaning device 14 are located along a rotating direction (refer to arrow X in FIG. 1) of the photosensitive drum 10.

Inside the printer main body 2, a sheet conveying path 15 is arranged. At an upper stream end of the conveying path 15, a sheet feeder 16 is positioned. At an intermediate stream part of the conveying path 15, a transferring unit 17 constructed of the photosensitive drum 10 and transfer roller 13 is positioned. At a lower stream part of the conveying path 15, a fixing device 18 is positioned. At a lower stream end of the conveying path 15, a sheet ejecting unit 20 is positioned. Below the conveying path 15, an inversion path 21 for duplex printing is arranged.

Next, the operation of forming an image by the printer 1 having such a configuration will be described.

When the power is supplied to the printer 1, various parameters are initialized and initial determination, such as temperature determination of the fixing device 18, is carried out. Subsequently, in the printer 1, when image data is inputted and a printing start is directed from a computer or the like connected with the printer 1, image forming operation is carried out as follows.

First, the surface of the photosensitive drum 10 is electrically charged by the charger 11. Then, exposure corresponding to the image data on the photosensitive drum 10 is carried out by a laser (refer to two-dot chain line P in FIG. 1) from the exposure device 8, thereby forming an electrostatic latent image on the surface of the photosensitive drum 10. Subsequently, the electrostatic latent image is developed to a toner image with a toner (a developer) in the development device 12.

On the other hand, a sheet fed from the sheet feeding cartridge 3 by the sheet feeder 16 is conveyed to the transferring unit 17 in a suitable timing for the above-mentioned image forming operation, and then, the toner image on the photosensitive drum 10 is transferred onto the sheet in the transferring unit 17. The sheet with the transferred toner image is conveyed to a lower stream on the conveying path 15 to go forward to the fixing device 18, and then, the toner image is fixed on the sheet in the fixing device 18. The sheet with the fixed toner image is ejected from the sheet ejecting unit 20 to the sheet ejecting tray 4. Toner remained on the photosensitive drum 10 is collected by the cleaning device 14.

Next, with reference to FIGS. 3-7, the toner container 5 will be described in detail. Because FIG. 4 is the back perspective sectional view, the left-hand and right-hand sides of the figure are converse to the actual left-hand and right-hand sides. That is, the right-hand side illustrated in FIG. 4 is the left-hand side of the toner container 5 and the left-hand side illustrated in FIG. 4 is the right-hand side of the toner container 5.

Figure 3:
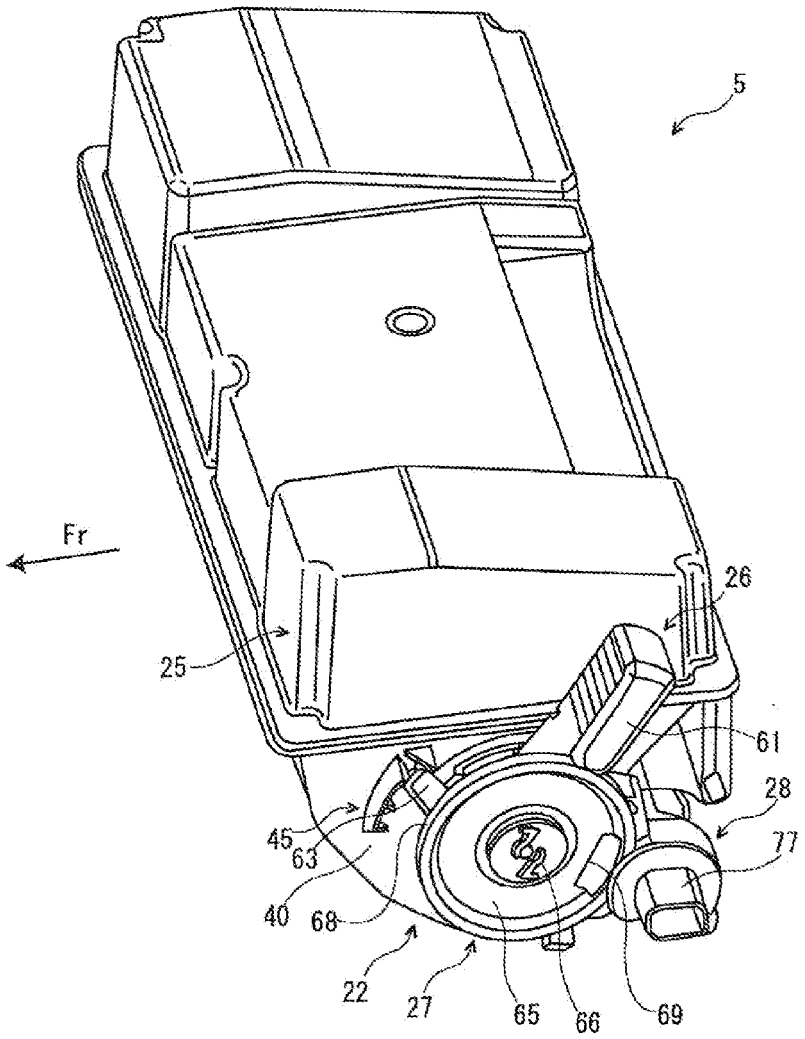
FIG. 3 is a right top perspective view showing a toner container in the printer according to the first embodiment of the present disclosure.
Figure 4:
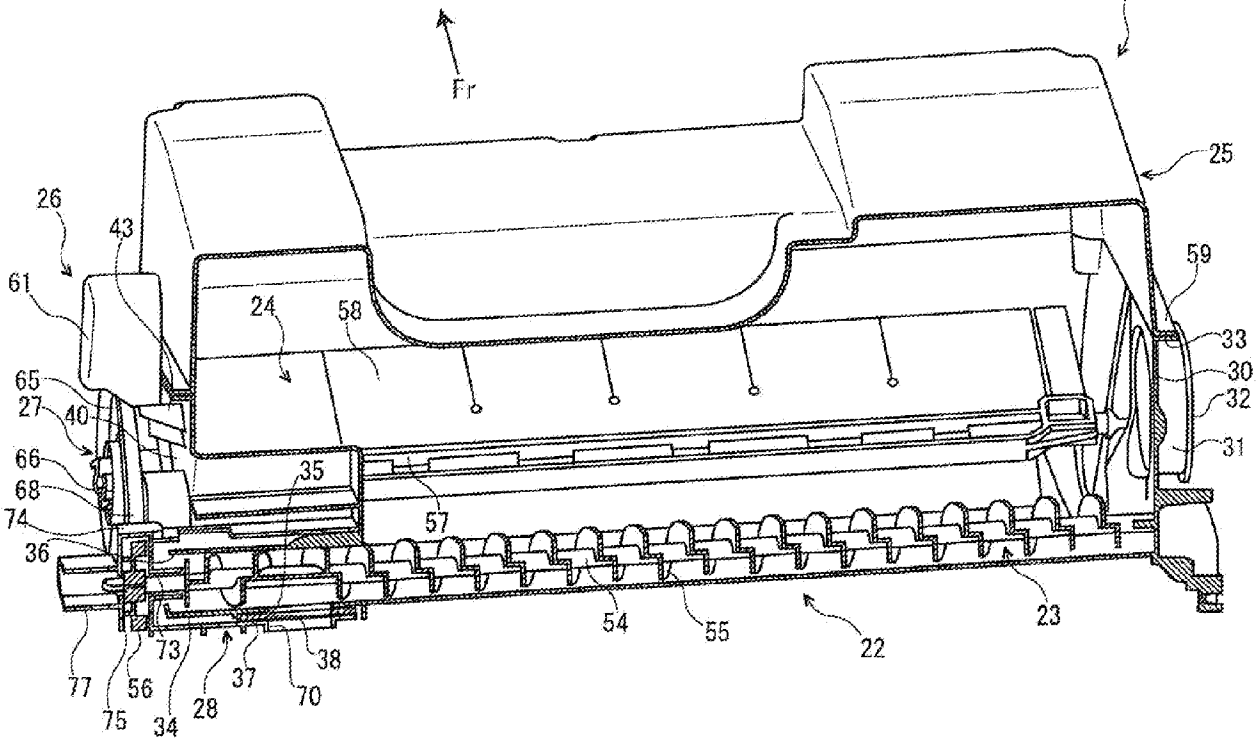
FIG. 4 is a back perspective sectional view showing the toner container in the printer according to the first embodiment of the present disclosure.

As shown in FIG. 3, the toner container 5 is formed in an extended-shape in left and right direction or a horizontal direction. As shown in FIG. 4, the toner container 5 includes a box-formed container main body 22 (case main body) with an opened top surface, a conveying screw 23, an agitating paddle 24, a covering body 25, a lever (an operation part) 26, a transmitting member 27 and a shutter 28. The conveying screw 23 is installed to a lower rear part of the container main body 22. The agitating paddle 24 is installed near a center part of the container main body 22. The covering body 25 covers the top surface of the container main body 22. The lever 26 is attached to a right end of the container main body 22. The transmitting member 27 is placed on the right end of the container main body 22 together with the lever 26. The shutter 28 is attached on a right bottom end of the container main body 22. The transmitting member 27 is omitted in FIGS. 6 and 7.

The container main body 22 is formed in an extended-shape in the horizontal direction to contain the toner. As shown in FIG. 4, on a left end wall 30 of the container main body 22, a toner filling port 31 is formed and the toner filling port 31 is closed by a cap 32. On the circumference of a top end of the container main body 22, a main body side flange 33 is formed.

At the right bottom end of the container main body 22, a cylinder-formed discharge duct 34 is protruded to a right direction and, in a right end of the discharge duct 34, an aperture 36 is formed. In a bottom of the discharge duct 34, a discharge port 35 discharging the toner is bored. On the circumference of a lower part of the discharge duct 34, a sealing member 37 is attached and, in the sealing member 37, a communication port 38 is bored at a correspondent position to the discharge port 35.

Figure 5:
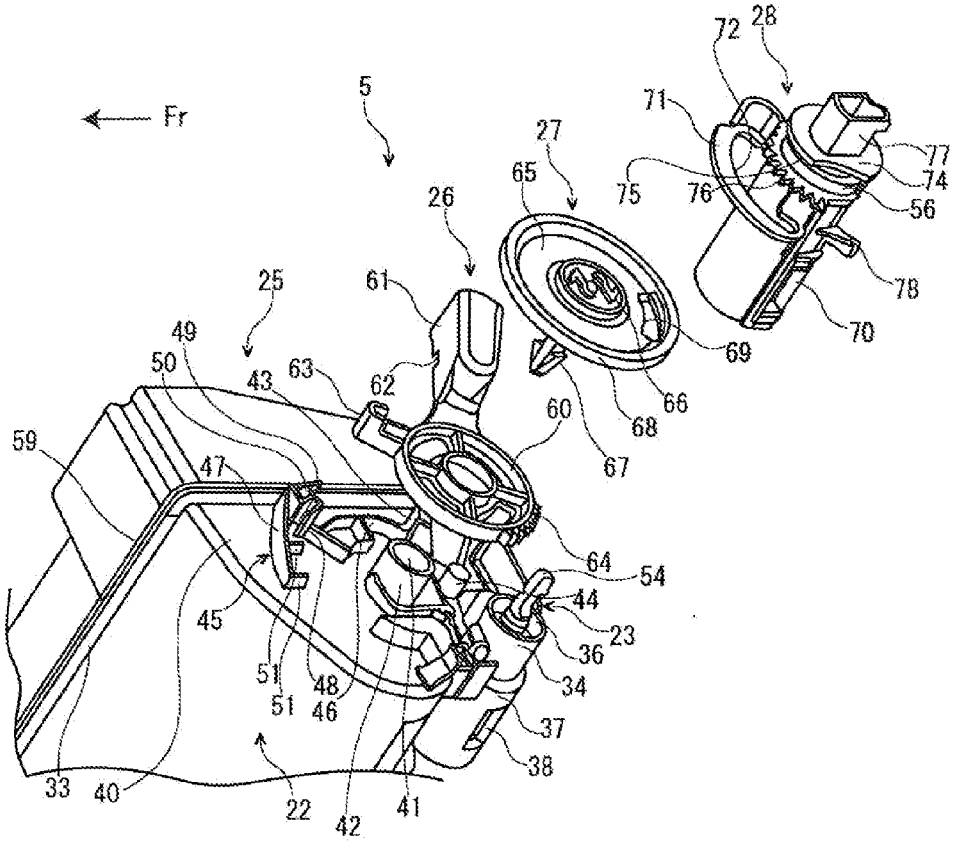
FIG. 5 is an exploded perspective view showing the toner container in the printer according to the first embodiment of the present disclosure.

As shown in FIG. 5, at the center of a right end wall 40 of the container main body 22, a cylinder-formed boss 42 having a communication hole 41 is protruded to a right direction (an outside direction). On a right surface (an external surface) of the right end wall 40 of the container main body 22, a restrain rib 43 is protruded to an upper backward direction of the boss 42. Below the restrain rib 43, a protrusion 44 is formed.

Figure 6:
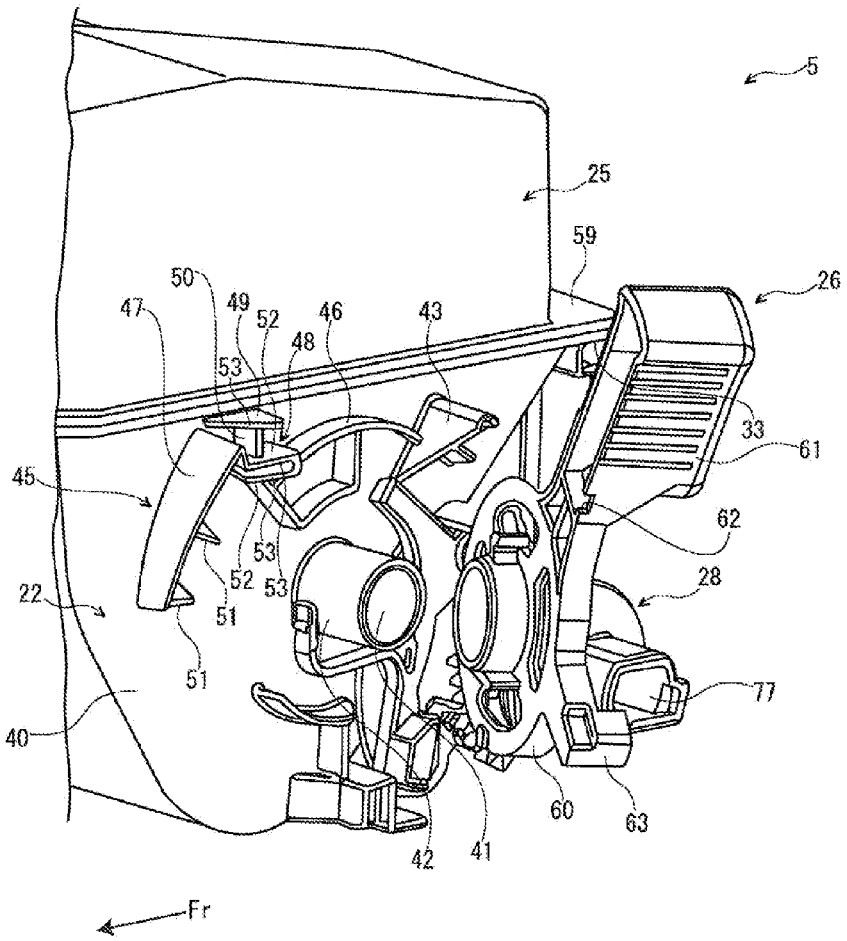
FIG. 6 is a front right perspective view showing the toner container in a situation, in which a lever is detached from a case main body, in the printer according to the first embodiment of the present disclosure.

As shown in FIG. 6, on the right surface (the external surface) of the right end wall 40 of the container main body 22, a stopper 45 is protruded to an upper forward direction of the boss 42. The stopper 45 is connected with the restrain rib 43 by a connecting rib 46.

The stopper 45 includes a curved piece 47, an engagement piece 48, a reinforcement piece 49 and a connection piece 50. The curved piece 47 curves in an arc-liked shape around the boss 42. The engagement piece 48 is connected with a rear side of an upper part of the curved piece 47. The reinforcement piece 49 is located above the engagement piece 48. The connection piece 50 connects the engagement piece 48 and reinforcement piece 49. On a lower part and an intermediate part in upper and lower direction or a vertical direction of the curved piece 47, support pieces 51 are protruded backward. The engagement piece 48 is formed in a U-shape laid on side to include a pair of upper and lower engagement plates 52. In the reinforcement piece 49 and engagement plates 52, inclined parts 53 are respectively formed. Each inclined part 53 inclines so that protruded length from the right surface of the right end wall 40 of the container main body 22 is gradually lengthen from a front side to a rear side.

As shown in FIG. 4, the conveying screw 23 is formed in an extended-shape in the horizontal direction and installed to the container main body 22 in a rotatable state. The conveying screw 23 includes a bar-formed rotating shaft 54 and a spiral fin 55 concentrically mounted on the circumference of the rotating shaft 54. A left end of the rotating shaft 54 is pivotally supported by the left end wall 30 of the container main body 22. Right side parts of the rotating shaft 54 and spiral fin 55 are inserted into the discharge duct 34. A right end of the rotating shaft 54 protrudes from the discharge duct 34 via the aperture 36 to the right direction and, on the protruding part, a conveying gear 56 is fixedly attached.

The agitating paddle 24 is located above and in front of the conveying screw 23 and formed in an extended-shape in the horizontal direction. The agitating paddle 24 is installed to the container main body 22 in a rotatable state. The agitating paddle 24 includes a supporting frame 57 formed in a frame plate-liked shape and a sheet-formed agitating fin 58 supported by the supporting frame 57. Left and right ends (both horizontal ends) of the supporting frame 57 are pivotally supported by the left end wall 30 and right end wall 40 of the container main body 22. The agitating fin 58 is formed out of plastic sheet, e.g. lumirror. One side of the agitating fin 58 is fixedly attached onto the supporting frame 57 along the horizontal direction.

On a bottom end of the covering body 25, a covering body side flange 59 is formed in the correspondent form to the main body side flange 33 of the container main body 22. The main body side flange 33 and covering body side flange 59 are ultrasonic-welded together so that the container main body 22 and covering body 25 are unified.

Figure 7:
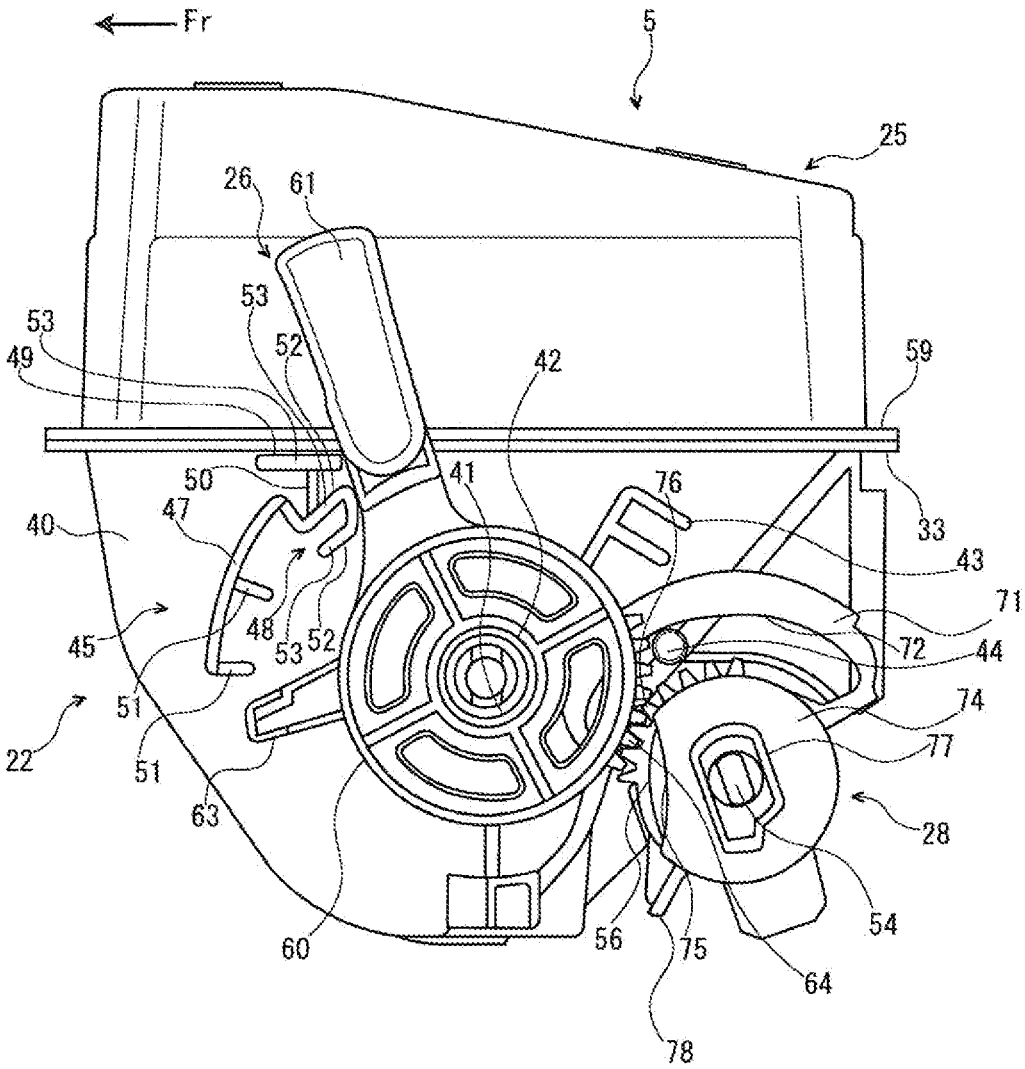
FIG. 7 is aright side view showing the toner container in the printer according to the first embodiment of the present disclosure.

As shown in FIG. 7, the lever 26 includes a lever main body 60 with a circular profile in a side view. The lever main body 60 is attached on the circumference of the boss 42 arranged on the right end wall 40 of the container main body 22. Thereby, the lever 26 is rotatably supported to the container main body 22 so that the lever 26 turns along the right surface of the right end wall 40 of the container main body 22. On an upper part of the lever main body 60, a gripper 61 is protruded to the outside in the radial direction. A top end of the gripper 61 extends to the right side of the covering body 25. As shown in FIG. 6, the gripper 61 is hollow and, in a lower front part of the gripper 61, a depression 62 is formed. On the lever main body 60, a protrusion piece 63 is protruded to the outside in the radial direction at a front side of the gripper 61. On the circumference of a lower rear part of the lever main body 60, lever side gear 64 (refer to FIG. 7) is formed.

As shown in FIG. 5, the transmitting member 27 includes a disc-formed transmitting member main body 65. On a right surface (an external surface) of the transmitting member main body 65, a transmission coupling 66 is protruded. The transmission coupling 66 is attachably/detachably jointed to a drive coupling (not shown) connected with a driver (not shown), such a motor. Accordingly, when the driver rotates, this rotation is transmitted to the transmitting member 27, and then, the transmitting member 27 rotates.

On a left surface (an internal surface) of the transmitting member main body 65, an insertion piece 67 is protruded. The insertion piece 67 is inserted into the communication hole 41 bored in the boss 42 of the container main body 22, and then, jointed to the supporting frame 57 of the agitating paddle 24. Accordingly, when the transmitting member 27 rotates, this rotation is transmitted to the agitating paddle 24, and then, the agitating paddle 24 rotates so that the toner in the container main body 22 is agitated and conveyed to the conveying screw 23.

On the circumference of the transmitting member main body 65, a transmission gear 68 is formed. The transmission gear 68 meshes with the conveying gear 56 of the conveying screw 23. Accordingly, when the transmitting member 27 rotates, this rotation is transmitted to the conveying screw 23, and then, the conveying screw 23 rotates so that the toner in the container main body 22 is discharged from the discharge port 35 and filled into the development device 12 (refer to FIG. 1). In the outside part of the transmitting member main body 65 in the radial direction, an opening 69 curved in an arc-liked shape is bored.

The shutter 28 is formed in a roughly cylinder-liked shape and rotatably installed to the circumference of the discharge duct 34 of the container main body 22. In a lower surface of the shutter 28, a discharge opening 70 is bored. As shown in FIG. 7, on the shutter 28, a roughly fan-formed guiding piece 71 is protruded. In the guiding piece 71, an arc-formed guiding hole 72 is formed and, with the guiding hole 72, the protrusion 44 of the container main body 22 engages.

As shown in FIG. 4, in the shutter 28, a cylinder-formed bearing 73 is formed and, into the bearing 73, the right end of the rotating shaft 54 of conveying screw 23 is pivotally supported. On the right side of the bearing 73, a gear box 74 is attached and the gear box 74 houses the conveying gear 56. As shown in FIG. 5, in the gear box 74, a communication aperture 75 is formed so that the conveying gear 56 can be housed in the gear box 74 via the communication aperture 75.

The shutter 28 is provided with a shutter side gear 76. The shutter side gear 76 meshes with the lever side gear 64 of the lever 26. Thereby, the lever 26 is connected to the shutter 28 so that the shutter 28 turns in the opposite direction to the lever 26 accompanying to the turn of the lever 26. On the right end of the shutter 28, an elliptic locking piece 77 is attached. In a lower part of the shutter 28, a pressing protrusion 78 is formed at the right side of the discharge opening 70.

Next, the front cover 6 will be described with reference to FIGS. 8 and 9. It is noted that terms indicating direction such as up and low, right and left, and front and rear will be used on a basis of the condition in which the front cover 6 is closed (see FIG. 8) hereinafter.

Figure 8:
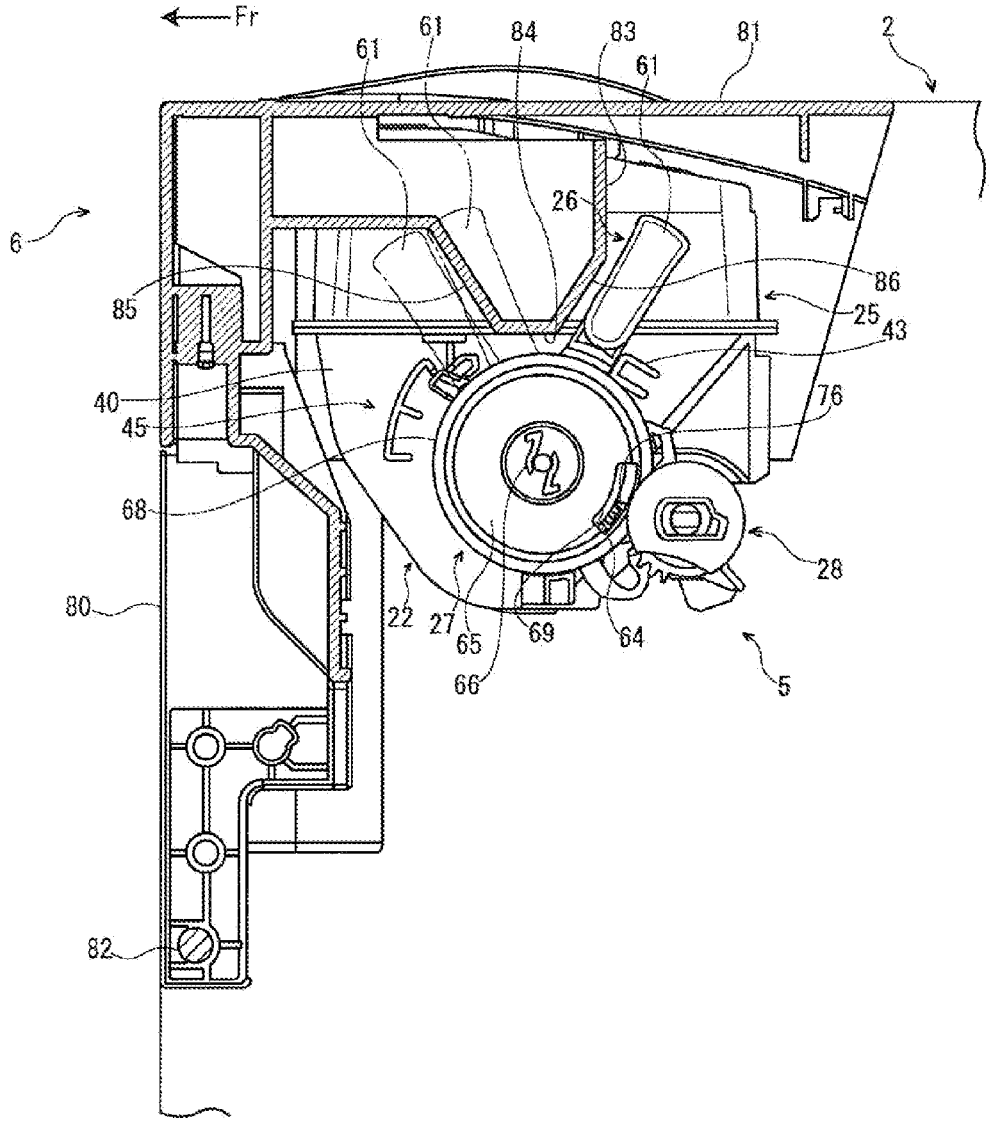
FIG. 8 is a sectional view showing a condition in which a front cover is closed and the lever is located at a port opening position in the printer of the first embodiment of the present disclosure.

As shown in FIG. 8, the front cover 6 has a side plate 80 covering a side of the toner container 5 (the front side in the present embodiment) and an upper plate 81 bent inside (in the rear side in the present embodiment) from an upper end of the side plate 80 and covering an upper part of the toner container 5. That is, the front cover 6 is formed substantially into a shape of letter L in section.

Figure 9B:
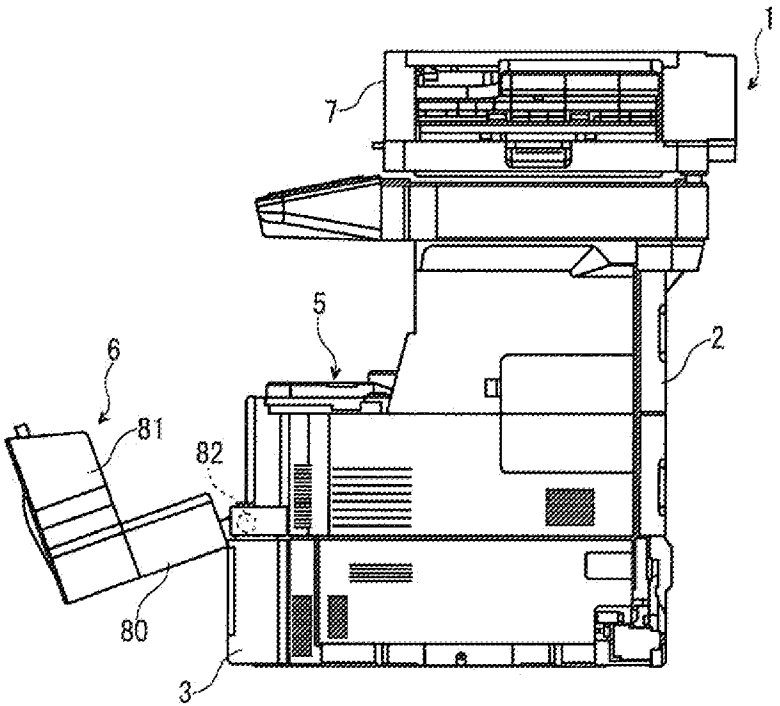
FIG. 9B is a side view showing a condition in which the front cover is opened in the printer according to the first embodiment of the present disclosure.
Figure 9A:
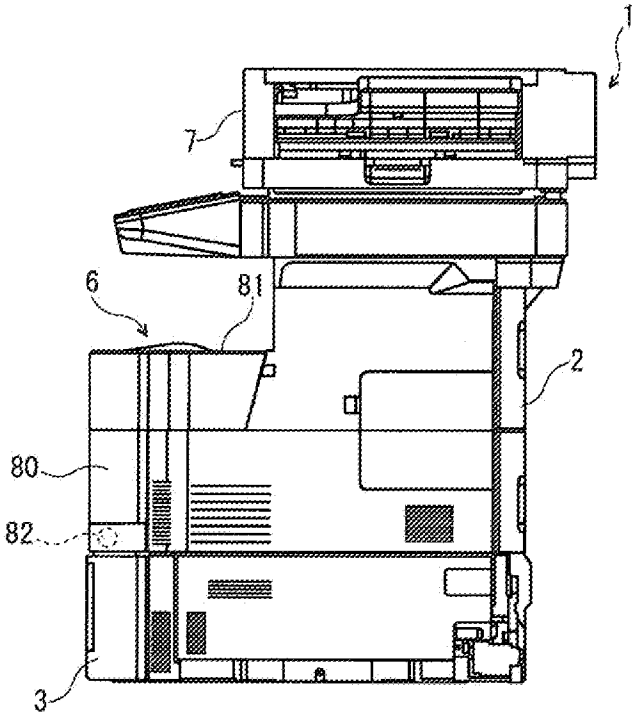
FIG. 9A is a side view showing a condition in which the front cover is closed in the printer according to the first embodiment of the present disclosure.

The side plate 80 extends in the vertical direction. The side plate 80 is provided with a spindle 82 at a lower end side thereof and the front cover 6 opens/closes by being turned around the spindle 82 as shown in FIGS. 9A and 9B.

As shown in FIG. 8, the upper plate 81 extends in the horizontal direction. The upper plate 81 is provided with a base part 83 formed into a rectangular shape in a side view at an inner surface (at an undersurface in the present embodiment) and a protrusion 84 formed into a trapezoidal shape at an underside (inner side) of the base part 83. The protrusion 84 has a first guide face 85 inclined downward in the rear direction (one direction in the front and rear direction) at a front end part (one end part) thereof and a second guide face 86 inclined downward in the front direction (the other direction in the front and rear direction) at a rear end part (the other one end part) thereof.

An operation of the lever 26 will be described with reference mainly to FIGS. 10 through 12 in the toner container 5 constructed as described above. It is noted that FIGS. 12A through 12C show a part of an engage piece 48 of the stopper 45.

Figure 10A:
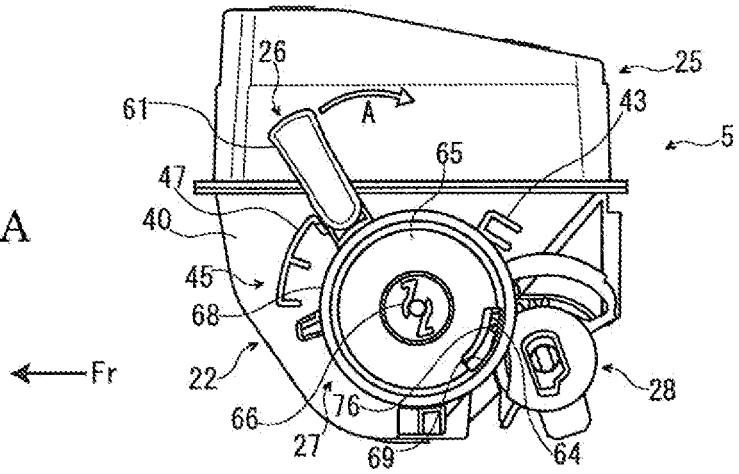
FIG. 10A is a right side view showing a condition in which the lever is located at a shipping position in the toner container of the printer according to the first embodiment of the present disclosure.
Figure 11A:
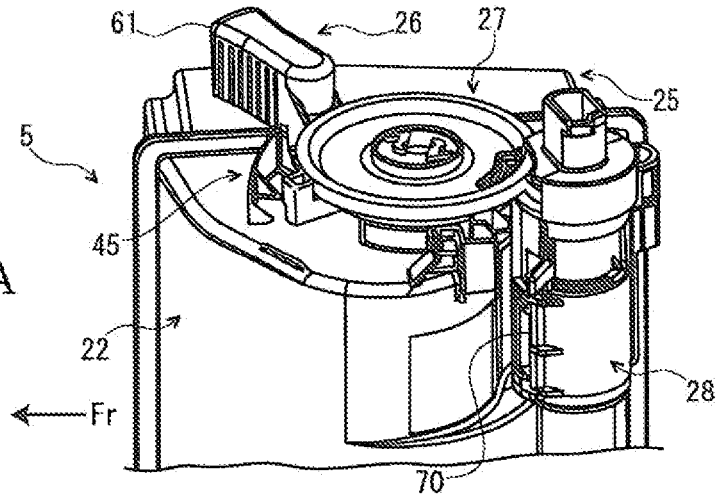
FIG. 11A is a bottom perspective view showing the condition in which the lever is located at the shipping position in the toner container of the printer according to the first embodiment of the present disclosure.
Figure 12A:
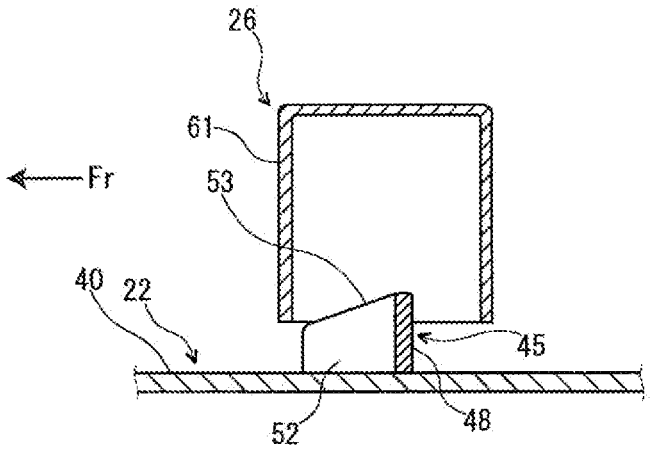
FIG. 12A is a schematic diagram showing a condition in which a gripper of the lever is engaged with a stopper in the toner container of the printer according to the first embodiment of the present disclosure.
Figure 12B:
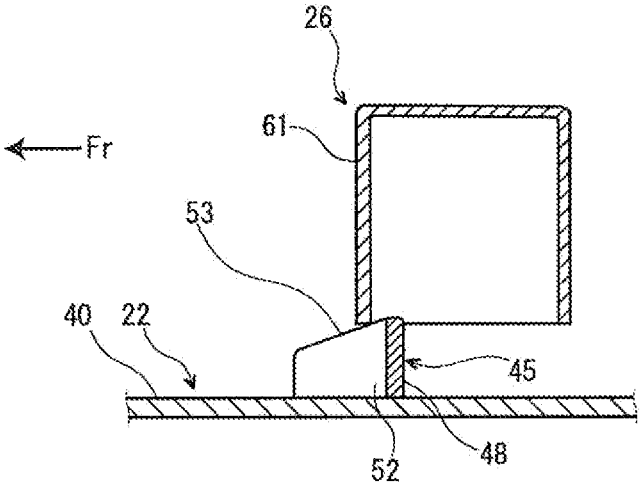
FIG. 12B is a schematic diagram showing a condition in a middle of shifting from the engaging condition in which the gripper of the lever is engaged with the stopper to an engagement releasing condition in the toner container of the printer according to the first embodiment of the present disclosure.

When the printer 1 is shipped out, the gripper 61 of the lever 26 is inclined forward as shown in FIG. 10A and the shutter 28 closes the discharge port 35 of the container main body 22 as shown in FIG. 11A. Still further, as shown in FIG. 12A, turn of the lever 26 is restricted by engaging the gripper 61 of the lever 26 with the stopper 45. A position of the lever 26 at this will be referred to as a "shipping position" hereinafter.

When the front cover 6 is closed in the state in which the lever 26 is located at the shipping position, the first guide face 85 of the protrusion 84 of the front cover 6 faces the gripper 61 of the lever 26 as indicated by a dashed line in FIG. 8. At this time, the gripper 61 of the lever 26 does not interfere with the protrusion 84 of the front cover 6, and the closure of the front cover 6 is permitted.

Meanwhile, when the printer 1 is used, an operator such as a user or a service man of the printer 1 presses the gripper 61 of the lever 26 to the rear side as indicated by an arrow A in FIG. 10A. By being pressed as described above, the gripper 61 of the lever 26 moves to the rear side along each inclined part 53 (FIGS. 12A through 12C show the inclined part 53 of the upper engagement plate 52) of the stopper 45 as shown in FIG. 12B. At this time, a pressing force that rotates the lever 26 to the rear side is lessened more or less as a depression 62 (see FIG. 6 and others) provided in the gripper 61 of the lever 26 engages with the underside engagement plate 52.

Figure 10B:
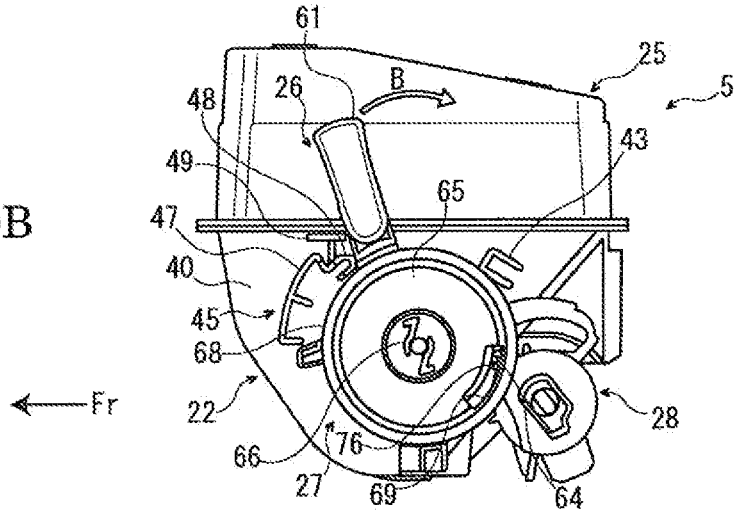
FIG. 10B is a right side view showing a condition in which the lever is located at a port closing position in the toner container of the printer according to the first embodiment of the present disclosure.
Figure 11B:
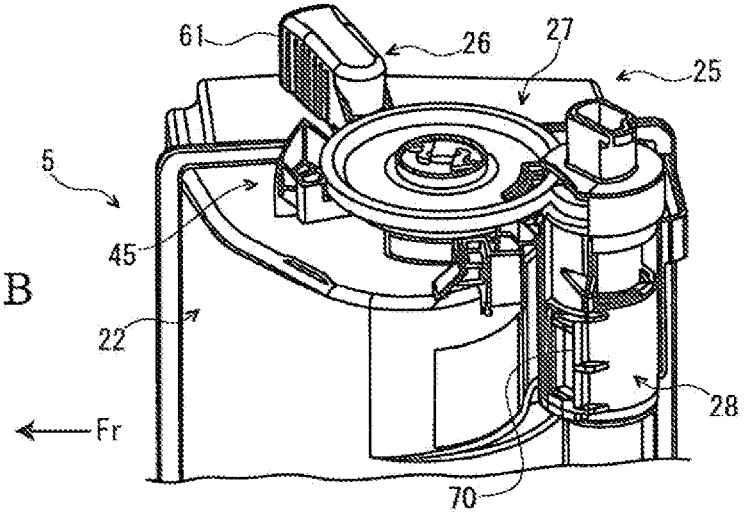
FIG. 11B is a bottom perspective view showing the condition in which the lever is located at the port closing position in the toner container of the printer according to the first embodiment of the present disclosure.
Figure 12C:
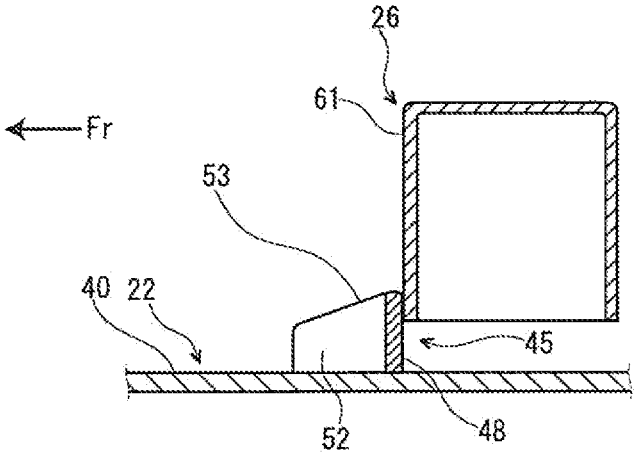
FIG. 12C is a schematic diagram showing the condition in which the gripper of the lever is disengaged from the stopper in the toner container of the printer according to the first embodiment of the present disclosure.

When the gripper 61 of the lever 26 is pressed continuously to the rear side, the gripper 61 of the lever 26 gets over each inclined part 53 of the stopper 45 as shown in FIG. 12C. Thereby, the engagement of the gripper 61 of the lever 26 with the stopper 45 is released and the lever 26 turns to a position slightly on the rear side from the shipping position as shown in FIG. 10B. The position of the lever 26 at this time will be referred to as a "port closing position" hereinafter. When the lever 26 thus turns from the shipping position to the port closing position, while the shutter 28 is also turned slightly along with that, the shutter 28 still closes the discharge port 35 of the container main body 22 as shown in FIG. 11B.

Even if the operator tries to close the front cover 6 in the state in which the lever 26 is located at the port closing position, the closure of the front cover 6 is prevented because the gripper 61 of the lever 26 interferes with the protrusion 84 of the front cover 6 as indicated by a two-dot chain line in FIG. 8.

Figure 10C:
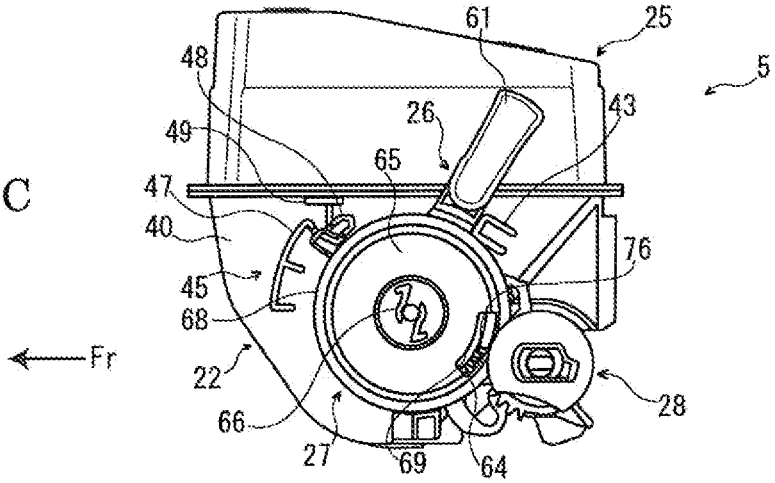
FIG. 10C is aright side view showing a condition in which the lever is located at a port opening position in the toner container of the printer according to the first embodiment of the present disclosure.

Next, when the operator presses the lever 26 further to the rear side as indicated by an arrow B shown in FIG. 10B, the lever 26 turns to a position on the rear side further from the port closing position as shown in FIG. 10C. The position of the lever 26 at this time will be referred to as a "port opening position" hereinafter. When the front cover 6 is closed in the state in which the lever 26 is located at the port opening position, the second guide face 86 of the protrusion 84 of the front cover 6 faces the gripper 61 of the lever 26 as indicated by a solid line in FIG. 8. At this time, the gripper 61 of the lever 26 does not interfere with the protrusion 84 of the front cover 6, and the closure of the front cover 6 is permitted.

Figure 11C:
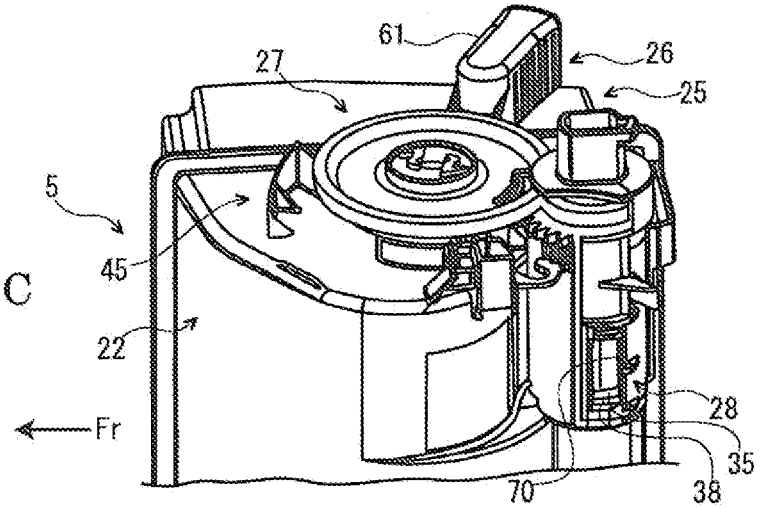
FIG. 11C is a bottom perspective view showing the condition in which the lever is located at the port opening position in the toner container of the printer according to the first embodiment of the present disclosure.

When the lever 26 turns from the port closing position to the port opening position as described above, the shutter 28 connected to the lever 26 also turns. Along with that, the shutter 28 opens the discharge port 35 of the container main body 22 as shown in FIG. 11C, and the inside of the container main body 22 communicates with the inside of the development device 12. This makes it possible to supply the toner from the toner container 5 to the development device 12. When the lever 26 thus turns from the port closing position to the port opening position, the toner container 5 is restricted from being detached from the printer main body 2.

It is noted that the discharge port 35 of the container main body 22 is closed by the shutter 28 by turning the lever 26 from the port opening position to the port closing position in replacing the toner container 5. Along with that, the toner container 5 is permitted to be detached from the printer main body 2. The toner container 5 can be pulled out of the printer main body 2 in this condition.

As described above, the present embodiment makes it possible to close the front cover 6 in the state in which the shutter 28 closes the discharge port 35 of the container main body 22 by attaching the toner container 5 to the printer main body 2 in the state in which the lever 26 is located at the shipping position. Along with that, it becomes possible to package and ship the printer main body 2 together with the toner container 5 while reliably preventing the toner from leaking out of the toner container 5 during transport of the toner container 5. Due to that, no packaging material dedicated for packaging the toner container 5 is required and shipping costs can be cut.

Still further, because the gripper 61 of the lever 26 engages with the stopper 45 and the lever 26 is restricted from turning in the state in which the lever 26 is located at the shipping position, it is possible to surely maintain the state in which the lever 26 is located at the shipping position. Accordingly, it is possible to prevent the lever 26 from turning from the shipping position to the port opening position by passing through the port closing position during shipment of the printer 1. Therefore, it is possible to prevent such a trouble that the toner leaks out of the toner container 5 during the shipment of the printer 1.

When the front cover 6 is closed in the state in which the lever 26 is located at the shipping position, the first guide face 85 provided on the protrusion 84 of the front cover 6 faces the gripper 61 of the lever 26. Therefore, it is possible to surely maintain the state in which the lever 26 is located at the shipping position.

The gripper 61 of the lever 26 gets over each inclined part 53 of the stopper 45 when the gripper 61 of the lever 26 is shifted from the state in which the gripper 61 is engaged with the stopper 45 to the state in which the engagement is released. Accordingly, it is possible to prevent the lever 26 that has turned once from the shipping position to the port closing position from returning again to the shipping position.

By the way, even if the operator tries to close the front cover 6 in the state in which the lever 26 is located at the port closing position, the front cover 6 is prevented from closing because the gripper 61 of the lever 26 interferes with the protrusion 84 of the front cover 6 in the present embodiment as described above (see the two-dot chain line in FIG. 8). However, even in the state in which the lever 26 is located at the port closing position, there is a possibility that the front cover 6 is erroneously closed when the operator pushes down the front cover 6 by a strong force. Then, the present embodiment is configured to reliably prevent the front cover 6 from being closed during the state in which the lever 26 is located at the port closing position.

Figure 13:
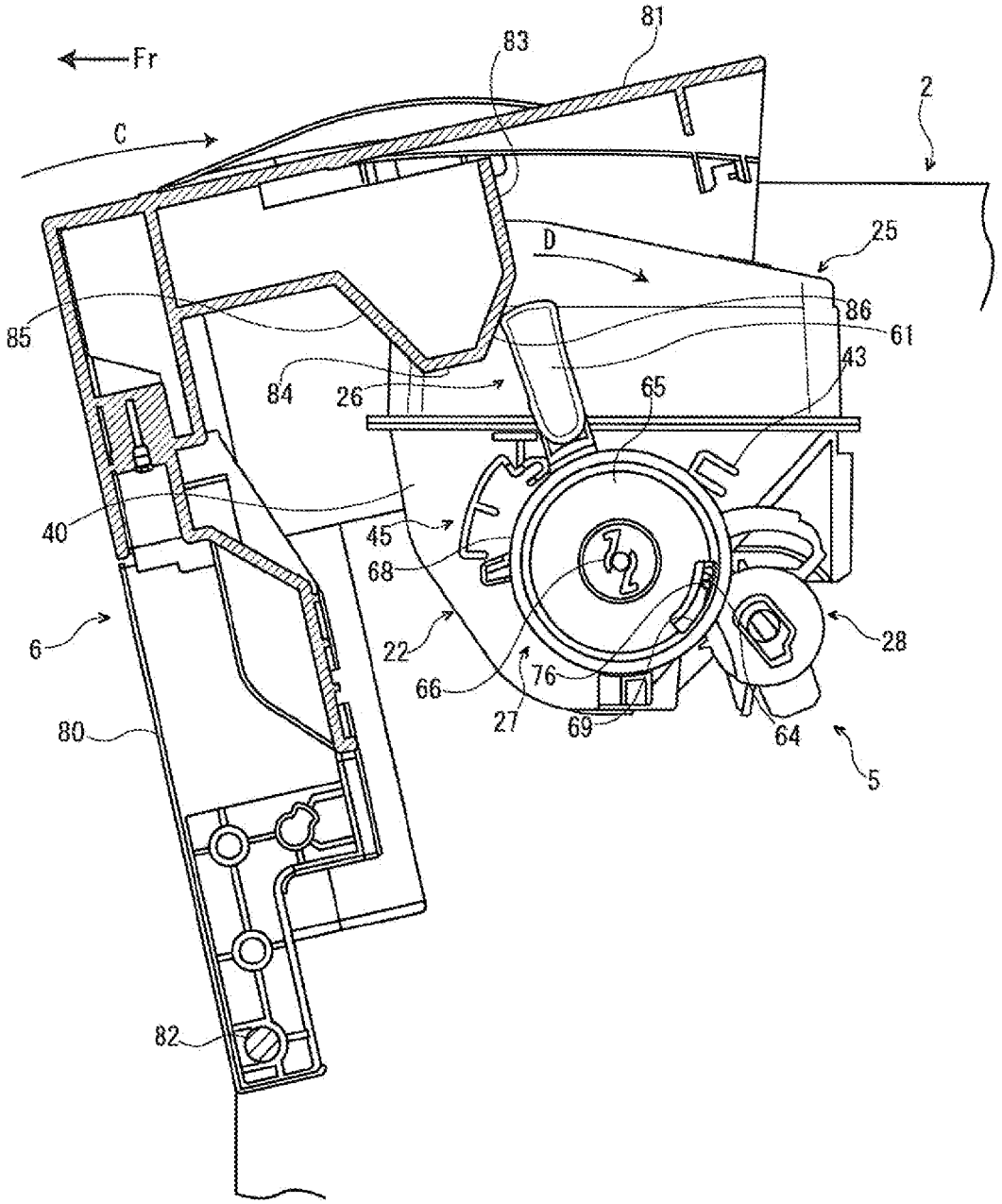
FIG. 13 is a sectional view showing a condition in a middle of closing the front cover from the condition in which the lever is located at the port closing position in the printer according to the first embodiment of the present disclosure.

When the front cover 6 is closed in the state in which the lever 26 is located at the port closing position as indicated by an arrow C in FIG. 13, the second guide face 86 of the protrusion 84 provided in the front cover 6 comes into contact with and presses the gripper 61 of the lever 26 to the rear side. This pressure turns the lever 26 to the rear side as indicated by an arrow D in FIG. 13. Then, when the front cover 6 is completely closed, the lever 26 turns from the port closing position to the port opening position and the second guide face 86 of the protrusion 84 faces the gripper 61 of the lever 26 that has turned to the port opening position as indicated by the solid line in FIG. 8.

As described above, the present embodiment makes it possible to turn the lever 26 from the port closing position to the port opening position in linkage with the closure of the front cover 6 even if the toner container 5 is attached to the printer main body 2 in the state in which the lever 26 is located at the port closing position. Therefore, it is possible to reliably avoid the front cover 6 from being closed while the discharge port 35 is closed by the shutter 28.

The second guide face 86 of the protrusion 84 faces the gripper 61 of the lever 26 that has turned from the port closing position to the port opening position. Therefore, it is possible to surely maintain the state in which the lever 26 is located at the port opening position when the front cover 6 is closed.

The front cover 6 is also configured to be opened/closed by being turned around the spindle 82 provided at the lower end side of the side plate 80. Due to that, the gripper 61 of the lever 26 can be readily pressed by the protrusion 84 of the front cover 6 in closing the front cover 6 and the lever 26 can be reliably turned from the port closing position to the port opening position.

In the present embodiment, the side plate 80 of the front cover 6 covers the front part of the toner container 5. In other different embodiments, the side plate 80 of the front cover 6 may cover the left, right, rear or another side of the toner container 5. That is, "the side of the toner container 5" includes all directions except the upper and lower sides of the toner container 5.

The embodiment was described in case of applying the configuration of the disclosure to the front cover 6. However, in another embodiment, the configuration of the disclosure may be applied to an upper cover (a top cover), a left side cover, a right side cover, a rear cover, or the like.

The embodiment was described in case of forming the lever 26 and shutter 28 separately. However, in a further embodiment, the lever 26 and shutter 28 may be formed in a body.

Although the embodiment was described in a case where ideas of the disclosure are applied to the printer 1, as a furthermore embodiment, the ideas of the disclosure may be applied to another image forming apparatus except the printer 1, such as a copying machine, a facsimile or a multifunction peripheral.

Second Embodiment

Next, a second embodiment of the present disclosure will be described with reference to FIGS. 14 and 15. It is noted that because a configuration of the second embodiment is the same with the first embodiment except the front cover 6, an explanation of the configuration thereof will be omitted here. Terms indicating directions such as up and down, right and left, front and rear, and others are used on a basis of a condition in which the front cover 6 is closed (see FIG. 14).

The upper plate 81 of the front cover 6 is provided with a pressing part 91 at the rear side of the protrusion 84. The pressing part 91 includes a pair of front and rear side wall parts 92 and a bottom wall part 93 extending in the front and rear direction and linking lower edge parts of the pair of front and rear side wall parts 92. That is, the pressing part 91 is formed into a shape of a letter U in section. An upper end part of the front side wall part 92 is linked with a rear end part of the base part 83 by a link part 94 extending in the horizontal direction. The configuration of the front cover 6 other than that is the same with that of the first embodiment, so that an explanation thereof will be omitted here.

In the configuration described above, the operation of the lever 26 turning from the port closing position to the port opening position along with the closure of the front cover 6 is the same with that of the first embodiment, so that an explanation thereof will be omitted here.

Figure 14:
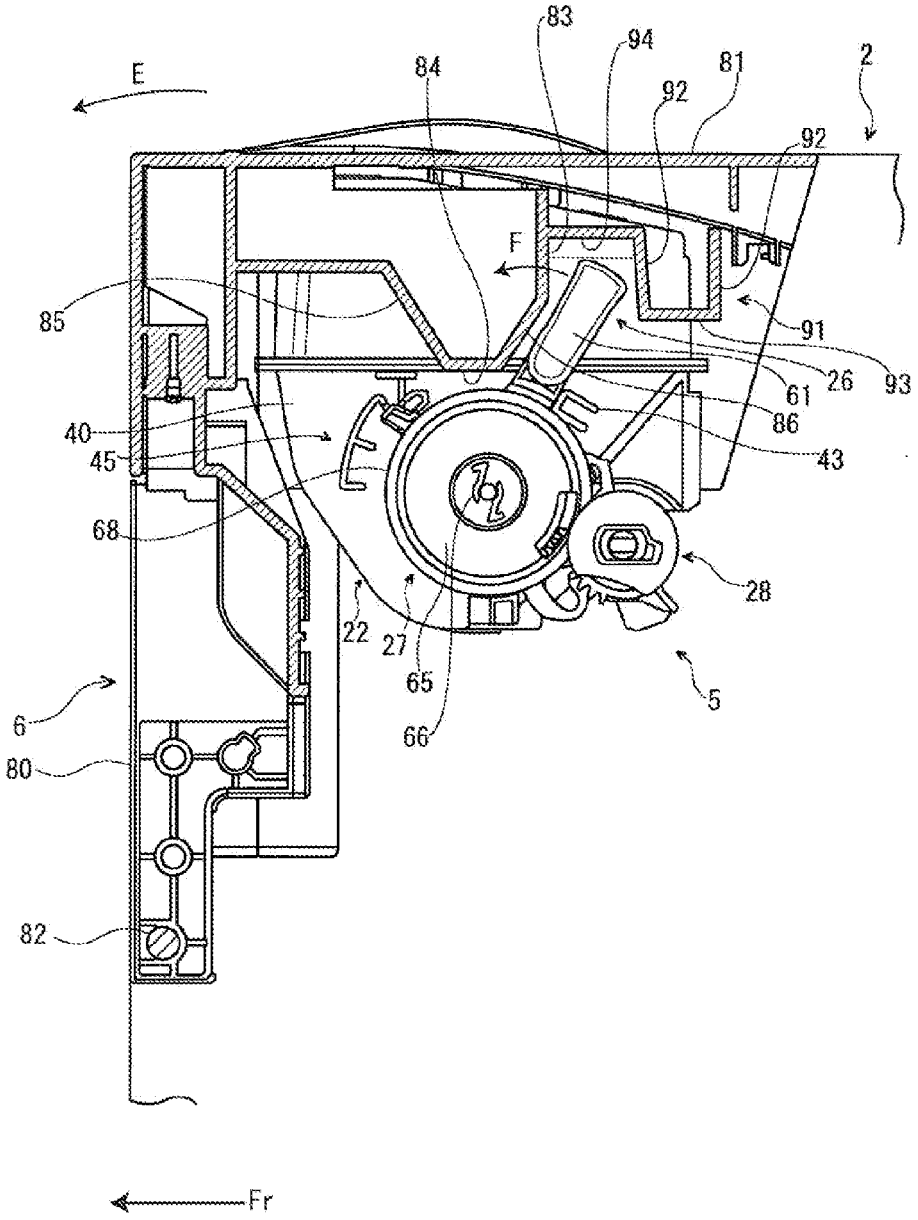
FIG. 14 is a sectional view showing a condition in which the front cover is closed and the lever is located at the port opening position in the printer according to a second embodiment of the present disclosure.
Figure 15:
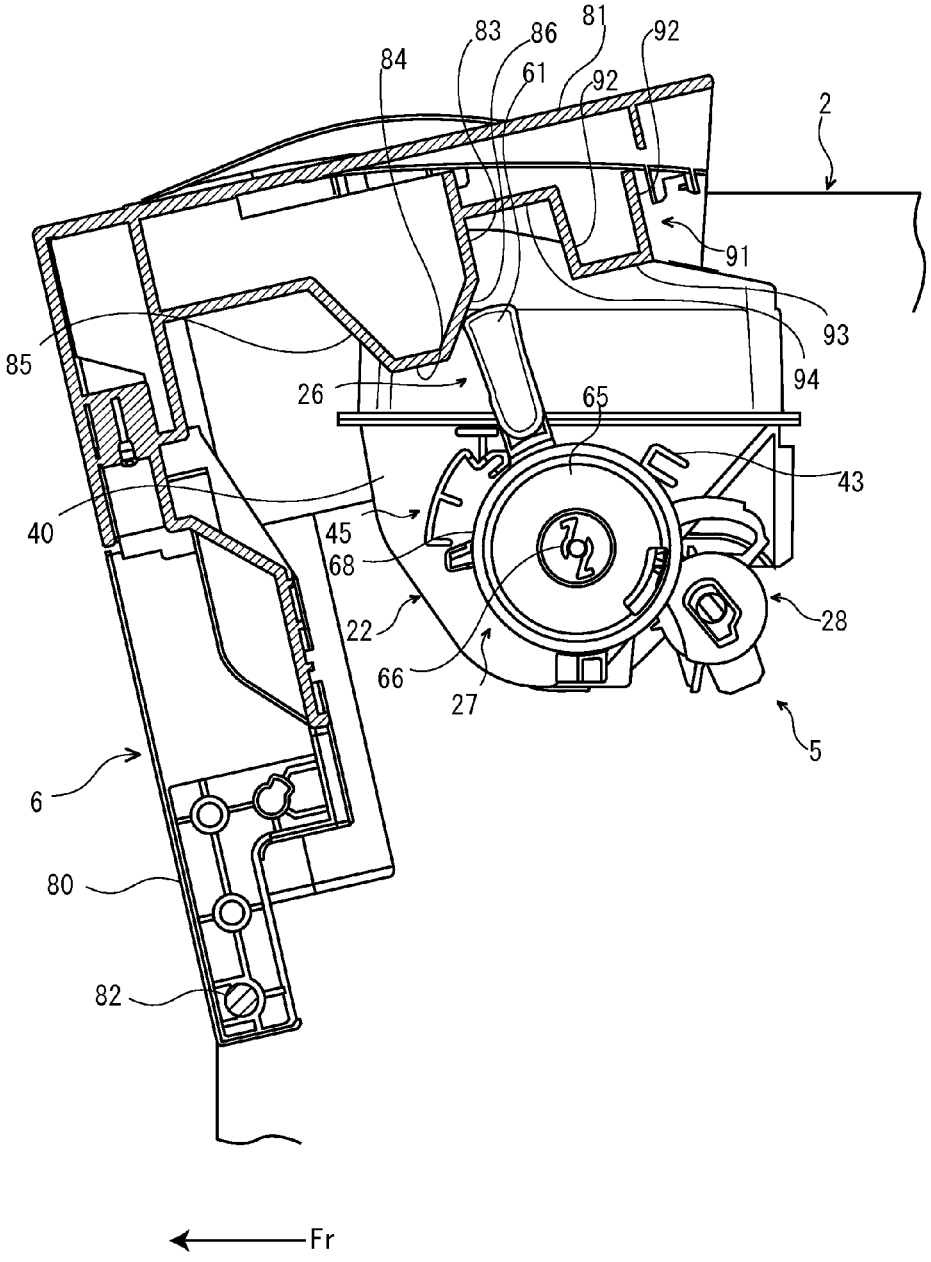
FIG. 15 is a sectional view showing a condition in a middle of opening the front cover from the condition in which the lever is located at the port opening position in the printer according to the second embodiment of the present disclosure.

Meanwhile, when the front cover 6 is opened in the state in which the lever 26 is located at the port opening position as indicated by an arrow E in FIG. 14, the front side wall part 92 of the pressing part 91 of the front cover 6 comes into contact with and presses the gripper 61 of the lever 26 to the front side. By being pressed as described above, the lever 26 turns to the front side as indicated by an arrow F in FIG. 14. Then, as the front cover 6 is opened further, the lever 26 turns from the port opening position to the port closing position as shown in FIG. 15.

The present embodiment makes it possible to turn the lever 26 from the port opening position to the port closing position in linkage with the opening of the front cover 6 as described above. Therefore, it is possible to prevent the toner container 5 from being detached from the printer main body 2 without closing the discharge port 35 by the shutter 28.

In particular, the printer 1 of the present embodiment is configured such that the detachment of the toner container 5 from the printer main body 2 is restricted in the state in which the lever 26 is located at the port opening position and the detachment of the toner container 5 from the printer main body 2 is permitted by turning the lever 26 from the port opening position to the port closing position. Therefore, as compared to a case where the operation of opening the front cover 6 and the operation of turning the lever 26 from the port opening position to the port closing position are performed separately, it is possible to readily replace the toner container 5 by reducing the number of processes of the work of removing the toner container 5 out of the printer main body 2 by turning the lever 26 from the port opening position to the port closing position in linkage with the operation of opening the front cover 6.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

a toner case including a case main body having a discharge port configured to discharge a toner, a shutter configured to open/close the discharge port, and an operation part connected to the shutter;

an apparatus main body to which the toner case is attachably/detachably installed; and a cover openably/closably attached to the apparatus main body and covering at least a part of the toner case, wherein the operation part is configured to be movable between a port closing position where the operation part makes the shutter close the discharge port and interferes with the cover and an port opening position where the operation part makes the shutter open the discharge port and permits the cover to be closed without interfering with the cover, when the cover is closed in the state in which the operation part is located at the port closing position, the cover presses the operation part and the operation part moves from the port closing position to the port opening position, when the cover is opened in the state in which the operation part is located at the port opening position, the cover presses the operation part and the operation part moves from the port opening position to the port closing position.

2. The image forming apparatus according to claim 1, wherein the cover includes a pressing part, the pressing part includes:

a pair of side wall parts; and a bottom wall part linking the pair of side wall parts, when the cover is opened in the state in which the operation part is located at the port opening position, one of the side wall parts presses the operation part.

3. The image forming apparatus according to claim 1, wherein the cover is provided with a protrusion at an inner surface thereof, when the cover is closed in the state in which the operation part is located at the port closing position, the protrusion presses the operation part, the operation part moves from the port closing position to the port opening position, and the protrusion faces the operation part that has moved to the port opening position.

4. The image forming apparatus according to claim 3, wherein the cover is provided with a base part projected from the inner surface thereof, and the protrusion is provided at an inner side of the base part.

5. The image forming apparatus according to claim 3, wherein a first guide face inclined downward in one direction in a front and rear direction is provided at one end part of the protrusion, a second guide face inclined downward in another direction in the front and rear direction is provided at another end part of the protrusion, when the cover is closed in the state in which the operation part is located at the port closing position, the second guide face presses the operation part.

6. The image forming apparatus according to claim 1, wherein the operation part is configured to be movable to a shipping position where the operation part makes the shutter close the discharge port and permits the cover to be closed without interfering with the cover.

7. An image forming apparatus comprising:

a toner case including a case main body having a discharge port configured to discharge a toner, a shutter configured to open/close the discharge port, and an operation part connected to the shutter;

an apparatus main body to which the toner case is attachably/detachably installed; and a cover openably/closably attached to the apparatus main body and covering at least a part of the toner case, wherein the operation part is configured to be movable between a port closing position where the operation part makes the shutter close the discharge port and interferes with the cover and an port opening position where the operation part makes the shutter open the discharge port and permits the cover to be closed without interfering with the cover, when the cover is closed in the state in which the operation part is located at the port closing position, the cover presses the operation part and the operation part moves from the port closing position to the port opening position, the cover includes:

a side plate covering a side of the toner case; and an upper plate bent inside from an upper end of the side plate and covering an upper part of the toner case, wherein the side plate is provided with a spindle at a lower end side thereof, and the cover is opened/closed by being turned around the spindle.

8. A toner case attachably/detachably installed to an apparatus main body of an image forming apparatus and at least partly covered by a cover openably/closably attached to the apparatus main body comprising:

a case main body having a discharge port configured to discharge a toner;

a shutter configured to open/close the discharge port; and an operation part connected to the shutter, wherein the operation part is configured to be movable between a port closing position where the operation part makes the shutter close the discharge port and interferes with the cover and an port opening position where the operation part makes the shutter open the discharge port and permits the cover to be closed without interfering with the cover, when the cover is closed in the state in which the operation part is located at the port closing position, the cover presses the operation part and the operation part moves from the port closing position to the port opening position, the operation part is configured to be movable to a shipping position where the operation part makes the shutter close the discharge port and permits the cover to be closed without interfering with the cover.

9. The toner case according to claim 8, wherein when the cover is opened in the state in which the operation part is located at the port opening position, the cover presses the operation part and the operation part moves from the port opening position to the port closing position.

10. The toner case according to claim 9, wherein the cover includes a pressing part, the pressing part includes:

a pair of side wall parts; and a bottom wall part linking the pair of side wall parts, when the cover is opened in the state in which the operation part is located at the port opening position, one of the side wall parts presses the operation part.

11. The toner case according to claim 8, wherein the cover is provided with a protrusion at an inner surface thereof, when the cover is closed in the state in which the operation part is located at the port closing position, the protrusion presses the operation part, the operation part moves from the port closing position to the port opening position, and the protrusion faces the operation part that has moved to the port opening position.

12. The toner case according to claim 11, wherein the cover is provided with a base part projected from the inner surface thereof, and the protrusion is provided at an inner side of the base part.

13. The toner case according to claim 11, wherein a first guide face inclined downward in one direction in a front and rear direction is provided at one end part of the protrusion, a second guide face inclined downward in another direction in the front and rear direction is provided at another end part of the protrusion, when the cover is closed in the state in which the operation part is located at the port closing position, the second guide face presses the operation part.

14. The toner case according to claim 8, wherein the cover includes:

a side plate covering a side of the toner case; and an upper plate bent inside from an upper end of the side plate and covering an upper part of the toner case, wherein the side plate is provided with a spindle at a lower end side thereof, and the cover is opened/closed by being turned around the spindle.

* * * * *